US007998281B2

(12) United States Patent
McCoy et al.

(10) Patent No.: US 7,998,281 B2
(45) Date of Patent: Aug. 16, 2011

(54) APPARATUS AND METHOD OF CLEANING A TRANSFER LINE HEAT EXCHANGER TUBE

(75) Inventors: James N. McCoy, Houston, TX (US); Arthur R. Di Nicolantonio, Seabrook, TX (US); Blair H. Margot, Madinat Yanbu Al-Sinatyah (SA); Subramanian Annamalai, Houston, TX (US); Stephen J. Vande Stouwe, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 254 days.

(21) Appl. No.: 11/634,301

(22) Filed: Dec. 5, 2006

(65) Prior Publication Data

US 2008/0128330 A1 Jun. 5, 2008

(51) Int. Cl.
*B08B 3/04* (2006.01)

(52) U.S. Cl. ..... 134/166 C; 134/169 C

(58) Field of Classification Search ..... 134/133, 134/56 R, 166 R
See application file for complete search history.

(56) References Cited

U.S. PATENT DOCUMENTS

| | | | | | |
|---|---|---|---|---|---|
| 3,416,598 | A | | 12/1968 | Dorn | |
| 3,617,478 | A | * | 11/1971 | King et al. | 208/48 AA |
| 4,038,786 | A | * | 8/1977 | Fong | 451/39 |
| 4,960,502 | A | * | 10/1990 | Holland | 208/85 |
| 5,092,981 | A | * | 3/1992 | Russo | 208/48 Q |
| 5,177,292 | A | * | 1/1993 | Lenglet | 585/648 |
| 5,186,815 | A | * | 2/1993 | Lenglet | 208/48 R |
| 5,284,994 | A | * | 2/1994 | Brown et al. | 585/648 |
| 5,324,486 | A | | 6/1994 | Russo | |
| 5,360,531 | A | | 11/1994 | Tong et al. | |
| 5,435,904 | A | * | 7/1995 | Reed et al. | 208/48 AA |
| 6,228,253 | B1 | | 5/2001 | Gandman | |
| 6,772,771 | B2 | * | 8/2004 | Cai et al. | 134/22.16 |
| 7,097,758 | B2 | | 8/2006 | Stell et al. | |
| 2003/0035766 | A1 | | 2/2003 | Baca et al. | |
| 2004/0004022 | A1 | | 1/2004 | Stell et al. | |
| 2005/0209495 | A1 | | 9/2005 | McCoy et al. | |
| 2005/0261537 | A1 | | 11/2005 | Stell et al. | |
| 2009/0090654 | A1 | * | 4/2009 | Duyvesteyn et al. | 208/106 |

FOREIGN PATENT DOCUMENTS

DE 29721479 * 4/1999

(Continued)

OTHER PUBLICATIONS

U.S. Appl. No. 11/487,780, Stell, et al., entitled "Process for Steam Cracking Heavy Oil Hydrocarbon Feed Stock", filed Jul. 17, 2006.
U.S. Appl. No. 11/177,975, Strack et al., entitled "Method for Processing Hydrocarbon Pyrolysis Effluent" filed Jul. 8, 2005.
U.S. Appl. No. 10/188,461, Stell et al., "Process for Steam Cracking Heavy Oil Hydrocarbon Feed Stock" filed Jul. 3, 2002.

(Continued)

*Primary Examiner* — Frankie L Stinson

(57) ABSTRACT

An apparatus for on-line cleaning and maintaining the cleanliness of a transfer line exchanger tube is provided. In one embodiment, the apparatus includes a housing having a first end, a second end and a longitudinal axis, the housing further including a first inlet for introducing a flushing fluid to the transfer line exchanger tube, the first inlet disposed proximate the first end of the housing, a second inlet for providing a product effluent comprising hydrocarbons and an outlet for placing in fluid communication with an inlet of the transfer line exchanger tube and a critical flow nozzle or flow control orifice, the critical flow nozzle or flow control orifice in fluid communication with the first inlet of the housing. Systems and processes for cleaning and maintaining the cleanliness of a transfer line exchanger are also disclosed.

16 Claims, 3 Drawing Sheets

FOREIGN PATENT DOCUMENTS

| | | | |
|---|---|---|---|
| EP | 1 348 753 | | 1/2003 |
| FR | 2 653 779 | * | 3/1991 |
| RU | 2061019 | * | 5/1996 |
| WO | 93/12200 | | 6/1993 |

OTHER PUBLICATIONS

U.S. Appl. No. 11/178,025, Strack et al., entitled "Method for Processing Hydrocarbon Pyrolysis Effluent" filed Jul. 8, 2005.

* cited by examiner

APPARATUS AND METHOD OF CLEANING A TRANSFER LINE HEAT EXCHANGER TUBE

FIELD OF THE INVENTION

The present invention relates generally to heat exchangers and more particularly to an apparatus and process for cleaning a transfer line heat exchanger tube.

BACKGROUND OF THE INVENTION

The production of ethylene requires a number of process steps through which any of a variety of hydrocarbon feeds can be refined to generate various products including ethylene. The predominate process for producing ethylene is steam cracking. According to this process, hydrocarbon feed is heated in a cracking furnace and in the presence of steam to high temperatures. The resulting products leave the furnace for further downstream processing.

Once the desired conversion of feed has been achieved, the process gas must be rapidly cooled, or quenched, to minimize undesirable continuing reactions that are known to reduce selectivity to ethylene. The vast majority of ethylene furnaces currently in use employ so-called "transfer line exchangers" (TLE). These devices are heat exchangers that rapidly cool the process gas by generating steam. The resulting steam is typically generated at high pressures (e.g. 600-2000 psig).

Many of the transfer line exchangers in service employ a double pipe or double tube construction with the high temperature cracking furnace effluent introduced into the interior pipe and a cooling medium such as water being introduced into the annular space between the two tubes. Double pipe exchangers may be configured as bundles or as so-called "linear" units. The advantage of the linear type unit is that the adiabatic time between the furnace outlet and the cooling tube inlet can be minimized to allow an enhanced ethylene selectivity. Linear units also benefit from the lack of a tubesheet area which would otherwise be exposed to the hot process gas and are thus subject to various mechanical and erosion concerns. Further, in linear units, the process flow is more evenly distributed among the cooling tubes, with no turbulence and recirculation in the inlet chamber that causes coking and polymerization of the valuable cracking products before entering the cooling tubes.

Steam generating transfer line exchangers have found particular utility in the initial quenching of effluent produced in furnaces cracking naphtha and lighter feeds. In liquid cracking furnaces processing heavy gas oil feeds, direct injection quench points are often required because of the rapid fouling that occurs in the TLE cooling tubes when the cracked gas is cooled below the dew point of the heavy ends of the cracked gas.

As may be appreciated, when gas or liquid feeds are cracked, high boiling point molecules are formed. A portion of these molecules are trapped on the radiant tube wall of the furnace where they polymerize to coke. Molecules not trapped enter the transfer line where they polymerize to form heavy, high boiling point asphaltene-type coke precursor molecules. When the cracked gas is cooled, these high boiling point coke precursor molecules condense and form a viscous liquid layer on the TLE cooling tube walls. The high velocity process gas in the cooling tube may sweep much of the liquid away, but some of it will be trapped on the cooling tube walls where it eventually will harden and turn to coke. The amount of coke formed on the cooling tube walls is a function of several factors: the severity of the cracking, the unfired residence time, the final boiling point of the heaviest molecules in the feed, the temperature to which the cracked gas is cooled in the transfer line exchanger, and the temperature of the transfer line exchanger cooling tube walls.

When the cracked gas traverses through the transfer line exchanger cooling tube, more of the heavy molecules contained therein polymerize to coke precursors as they are cooled to lower temperatures. As they proceed along the transfer line exchanger cooling tube, the amount of liquid and heavy molecules condensed on the tube wall increases as the temperature decreases, the viscosity of the condensed liquid increases and the condensed liquid is more readily trapped on the cooling tube walls. As a result, long transfer line exchangers that cool the cracked gas to low temperatures will coke more than shorter transfer line exchangers which do not cool the cracked gas to the same degree. Thus, for heavy feeds, short exchangers that cool the cracked gas to only about 950° F. (510° C.) are preferred.

In order to achieve best selectivity to ethylene, it is necessary to minimize both the residence time ("fired time") and the adiabatic time ("unfired residence time") within an ethylene furnace. The latter time refers to the amount of time required for the process effluent to pass from the fired zone of the furnace to the entrance of the TLE. One set of existing solutions that have been developed to minimize adiabatic time are the so called close-couple type transfer line exchangers. According to this design, the quench exchanger tubes are connected directly to the furnace effluent tubes without intermediate manifolding.

As indicated, the temperature of the wall of the transfer line exchanger cooling tube influences the amount of liquid condensed and the amount of coke formed in the TLE cooling tube. As may be appreciated, low temperature cooling tube walls coke more readily than high temperature walls. Therefore, transfer line exchangers designed for heavy feeds must generate high pressure (1500 psig) steam, while exchangers that cool the light gas feed generate medium pressure (600 psig) steam. Moreover, the higher the cracked gas velocity in the cooling tube, the thinner the liquid layer and the lower the amount of liquid that will be trapped on the cooling tube wall.

In view of these factors, close-coupled transfer line exchangers, even medium pressure (600 psig) steam generating transfer line exchangers, are frequently designed as double-pipe units. Advantageously, the close coupled design concept enables the unfired outlet time to quench to be shorter, thus enhancing selectivity. Additionally, separation in the unfired outlet zone can be minimized, thus minimizing coking between the fired zone and the TLE, avoiding conventional circular TLE inlet head coking, which can obstruct TLE tubes when spalled. Further advantages include the avoidance of conventional circular TLE inlet tubesheet coking, which can obstruct TLE tubes when spalled, the elimination of TLE inlet tubesheet erosion problems, and the enablement of faster and more effective decoking of the TLE. Each close-coupled TLE tube is fed either by a single radiant tube or dual radiant tubes.

Ethylene furnaces are typically used for the production of a wide variety of products. These include hydrogen at the light end to steam-cracked tar at the heavy end. As a general matter, the heavier the feedstock, the greater the yield of steam-cracked tar. In naphtha crackers, the effluent composition contains a tar content that is high enough that the heaviest components will commence condensing if cooled to approximately 600° F. (315° C.). As feedstocks get heavier, the tar yield rises and the temperature at which condensation commences also rises. Should condensation of the effluent occur in the transfer line exchanger, heat transfer is substantially impeded and a sharp increase in effluent outlet temperature occurs.

When the price of natural gas price is high relative to crude, gas cracking tends to be disadvantaged when compared with the cracking of virgin crudes and/or condensates, or the distilled liquid products from those feeds (e.g., naphtha, kerosene, field natural gasoline, etc.). However, cracking heavier feeds, such as kerosenes and gas oils, produces large amounts of tar, which leads to rapid fouling in the transfer line exchangers preferred in lighter liquid cracking service, often requiring costly shutdowns for cleaning. Nevertheless, in such an economic environment, it would be desirable to extend the range of useful feedstocks to include liquid feedstocks that yield higher levels of tar. Therefore, there is a need for an improved process and apparatus for removing the resulting heavy oils and tars that foul transfer line exchangers, without the need for costly shutdowns.

SUMMARY OF THE INVENTION

Provided is a system for on-line cleaning a foulant, such as a tar-based foulant, from a transfer line heat exchanger tube or transfer line exchanger assembly (TLE). In one preferred aspect the system comprises: (a) a TLE comprising a through bore, the TLE for cooling a cracked effluent; and (b) an apparatus for intermittently introducing a flushing fluid through the TLE through bore for cleaning and maintaining the cleanliness of the TLE; wherein the flushing fluid is introduced at a flushing fluid rate of from about 0.5 pounds-mass to about 5 pounds-mass of flushing fluid per pound-mass of cracked effluent feeding through the TLE through bore, while the cracked effluent is simultaneously fed through the TLE. On-line means that the cracker furnace is producing a cracked effluent stream and the cracked effluent stream continues to flow through the TLE(s) during flushing/cleaning, preferably without interruption of cracked effluent flow rate.

Also provided is a process for cleaning a TLE in a system for cracking hydrocarbons, the system including a hydrocarbon pyrolysis furnace that produces a stream of cracked effluent, a TLE that quenches the cracked effluent stream, and an inventive process for cleaning and maintaining the cleanliness of the TLE, the inventive process comprising the step of intermittently introducing a flushing fluid into the stream of cracked effluent in the TLE while the cracked effluent is fed through the TLE to remove foulant from the TLE.

In another preferred aspect, a process is provided for introducing a flushing fluid into a stream of cracked effluent moving through a TLE to clean the TLE. The process introduces flushing fluid into the effluent stream from a flushing fluid apparatus that comprises a housing having a first end, a second end, the housing further including a first inlet for introducing a flushing fluid into the flushing fluid apparatus, the first inlet disposed proximate the first end of the housing, a second inlet for providing the effluent stream into the flushing fluid apparatus, and an outlet in fluid communication with an inlet of the TLE and in fluid communication with both the first inlet and the second inlet.

In yet another embodiment, provided is a process in a system for thermal cracking gaseous feedstocks. The system includes a thermal cracker for cracking the gaseous feed and producing a cracked effluent stream comprising olefins, and at least one TLE for the recovery of process energy from the effluent, provided is a process for extending the range of system feedstocks for cracking to include liquid feedstocks that yield up to 40 wt % tar, the process comprises the steps of intermittently: (a) introducing a flushing fluid into the cracked effluent stream from an introduction point that is upstream of the at least one TLE; and (b) simultaneously introducing the cracked effluent stream and the flushing fluid into the at least one TLE to remove a tar-based foulant from the at least one TLE before the tar-based foulant cross-links. The at least one TLE may be a primary TLE or a secondary TLE.

In still another aspect, an apparatus is provided for cleaning and maintaining the cleanliness of a TLE, the apparatus comprising: (a) a conduit including a first inlet for introducing a flushing fluid into a stream of cracked effluent flowing through the conduit, a second inlet for providing the cracked effluent flow into the conduit, and an outlet in fluid communication with both the first inlet and the second inlet to introduce the flushing fluid and the cracked effluent into the TLE inlet; and (b) a flushing fluid source for providing the flushing fluid to the first inlet in the conduit; (c) a cracked effluent source for providing the cracked effluent to the second inlet to the conduit. The flushing fluid source may include a flushing fluid distribution connection or manifold, and the cracked effluent source may include a radiant tube from a cracker unit.

In another aspect, provided is an apparatus for cleaning and maintaining the cleanliness of a transfer line exchanger tube. The apparatus includes a housing having a first end, a second end and a longitudinal axis, the housing further including a first inlet for introducing a flushing fluid to the transfer line exchanger tube, the first inlet disposed proximate the first end of the housing, a second inlet for providing a product effluent comprising hydrocarbons and an outlet for placing in fluid communication with an inlet of the transfer line exchanger tube and a flow nozzle or flow control orifice, the flow nozzle or flow control orifice in fluid communication with the first inlet of the housing.

This invention also includes a TLE assembly comprising (i) a TLE including a through bore through the TLE, wherein, the TLE is for cooling/quenching a cracked effluent; and (ii) an apparatus for intermittently introducing a flushing fluid through the TLE through bore for cleaning and maintaining the cleanliness of the TLE. The flushing fluid is introduced at a flushing fluid rate of from about 0.5 pounds-mass to about 5 pounds-mass of flushing fluid per pound-mass of cracked effluent feeding through the TLE through bore. A TLE may be a primary TLE, secondary TLE, or other TLE type device and/or related piping. In a further aspect, provided is a process for extending the range of system feedstocks to include liquid feedstocks that yield up to 40 wt % tar, the process capable of use in a system for thermal cracking gaseous feedstocks. In a still further aspect, the flushing fluid is selected from the group of steam, quench oil, deasphalted tar and full tar.

In a still yet further aspect, the step of flushing TLE foulant has utility with the following range of feedstocks: cracking one or more of steam cracked gas oils and residues, heating oil, jet fuel, diesel, gasoline, coker naphtha, hydrocrackate, reformate, raffinate reformate, distillate, crude oil, atmospheric pipestill bottoms, vacuum pipestill streams including bottoms, wide boiling range naphtha to gas oil, naphtha contaminated with crude, atmospheric residuum, $C_4$/residue admixtures, and naphtha residue admixtures, condensate, heavy virgin naphtha, field natural gasoline or kerosene fed process effluent. These and other features are described herein with specificity so as to make the present invention understandable to one of ordinary skill in the art.

BRIEF DESCRIPTION OF THE DRAWINGS

The invention is further explained in the description that follows with reference to the drawings illustrating, by way of non-limiting examples, various embodiments of the invention.

DETAILED DESCRIPTION OF THE INVENTION

Disclosed herein is a device for cleaning and maintaining the cleanliness of a TLE in liquid hydrocarbon feed cracking, such as in a gas cracker, with relatively high TLE fouling service as compared to the fouling rate with a gas feed. Also disclosed is a heat exchanger assembly incorporating such a device and a process for maintaining the cleanliness of a TLE tube in heavy feed cracking and high TLE fouling service, each now described in specific terms sufficient to teach one of skill in the practice thereof. In the description that follows, numerous specific details are set forth by way of example for the purposes of explanation and in furtherance of teaching one of skill in the art to practice the invention. It will, however, be understood that the invention is not limited to the specific embodiments disclosed and discussed herein and that the invention can be practiced without such specific details and/or substitutes therefore. The present invention is limited only by the appended claims and may include various other embodiments which are not particularly described herein but which remain within the scope and spirit of the present invention.

Figure 1:
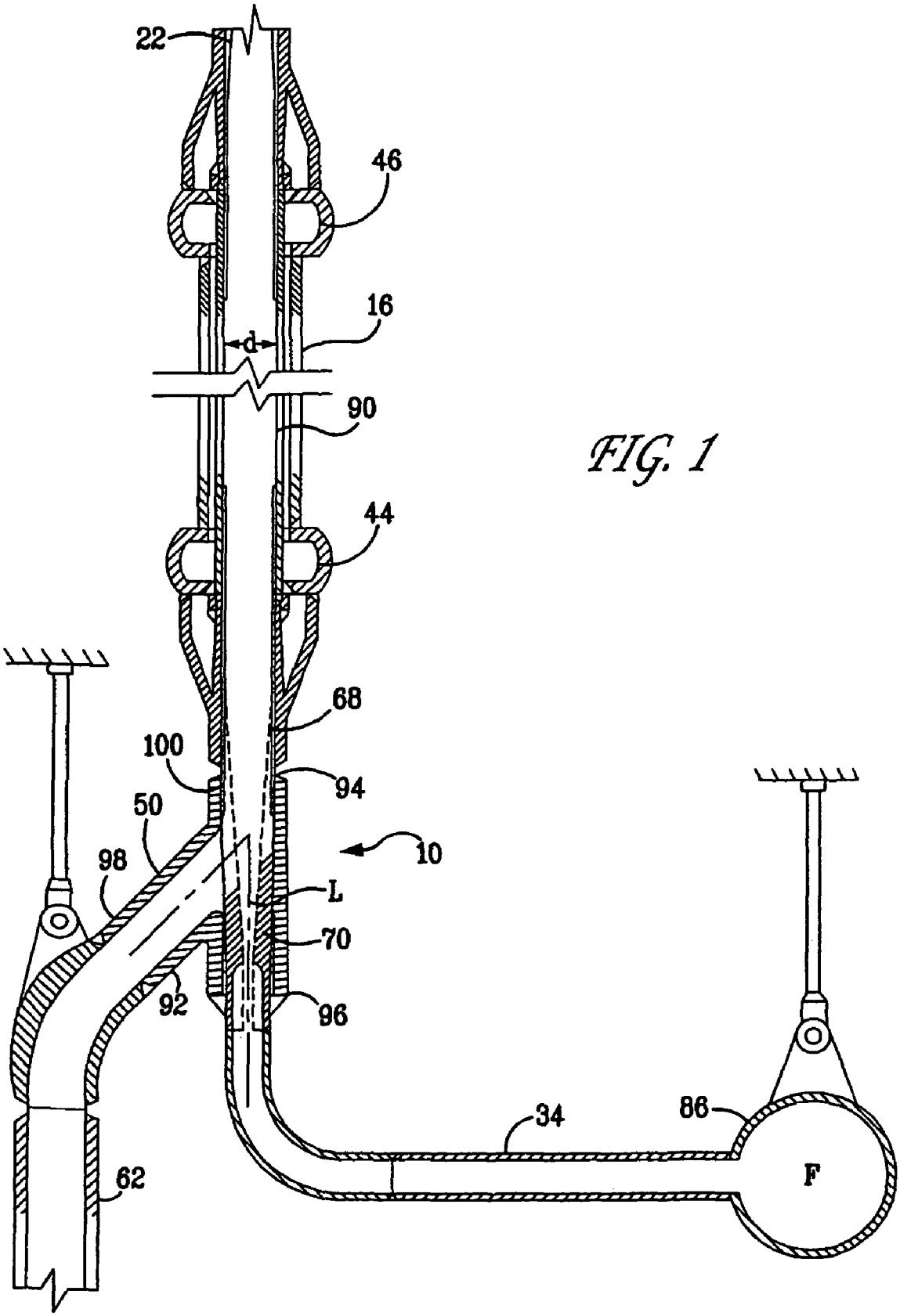
FIG. 1 is an exemplary cross-sectional illustration of a primary transfer line exchanger including an apparatus for cleaning and maintaining the cleanliness of a transfer line exchanger tube according to the present invention.

Referring now to FIG. 1, an exemplary device 10 or conduit for cleaning and maintaining a TLE tube 90 in an almost clean state in liquid hydrocarbon feed cracking, such as heavy feed cracking, and with corresponding, relatively high TLE fouling service is shown. The device, conduit, or apparatus 10 may include a body or housing 50 having a first end 92, a second end 94 and a longitudinal axis L extending from a first end to a second end of the apparatus. Although FIG. 1 illustrates a y-shaped housing, it will be understood by those skilled in the art that the shape and/or flow characteristics of the apparatus may vary widely and that the housing may comprise a single component or multiple components or segments. All variations are considered within the scope of the invention. The apparatus 10 may essentially comprise a conduit for transferring a liquid within a through bore through the apparatus. Housing 50 further includes a first inlet 96 for introducing a flushing fluid F into the transfer line exchanger tube 90 and into the cracked effluent stream from a thermal cracker. The first inlet 96 is preferably disposed proximate to the first end 92 of the housing 50 to facilitate mixing within the housing. Housing 50 also includes a second inlet 98 for providing a product effluent comprising hydrocarbons, such as a cracked effluent stream, and an outlet 100 in fluid communication with an inlet 68 of the transfer line exchanger tube 90, and also in fluid communication with both the first and the second inlets to introduce the flushing fluid and the cracked effluent into the TLE inlet 68.

A flushing fluid source 86 is also included to provide the flushing fluid F to the first inlet 96 in the conduit 68, and a cracked effluent source (not shown), such as a thermal cracker, e.g., a gas cracker or steam cracker, for providing the cracked effluent stream to the second inlet 98 to the conduit 10. The flushing fluid is preferably selected from at least one of the group of steam (including water), quench oil (including heavy, light, aromatic solvents and oils), deasphalted tar, and full tar. Preferably the flushing fluid F is introduced into the first inlet 96 from a distribution manifold 86. The TLE is used to cool cracked effluent from a thermal cracking furnace. The TLE may be concentrically disposed within a larger tube, e.g. a cooling tube, wherein a cooling fluid, such as steam or water, may be circulated within the annulus between the two tubes. According to one process, flushing fluid is preferably introduced at a frequency of at least about once every week, although in still more preferred aspects, the flushing fluid may be introduced more often, such as at least once per day, or even much more frequently, such as once per hour. The frequency and duration period for flushing fluid introduction into the cracked stream will be determined by the quality of feed stock and the tar and foulant yield and build-up rate on the inner wall of the TLE tube.

The cracked effluent preferably results from cracking one or more of steam cracked gas oils and residues, heating oil, jet fuel, diesel, gasoline, coker naphtha, hydrocrackate, reformate, raffinate reformate, distillate, crude oil, atmospheric pipestill bottoms, vacuum pipestill streams including bottoms, wide boiling range naphtha to gas oil, naphtha contaminated with crude, atmospheric residuum, C4/residue admixtures, and naphtha residue admixtures, a condensate, heavy virgin naphtha, field natural gasoline, and/or kerosene. The cracked effluent is at least partially quenched or cooled in the TLE, and the TLE may preferably be a primary TLE but the TLE may also include a secondary TLE, and/or multiple TLEs. The TLE may also include essentially a single tube or multiple tubes, as are known in the art. The shape of the TLE is generally not critical, as although the mechanical dispersion energy from the flushing fluid may assist with foulant cleanup, other flushing fluid mechanisms are primarily responsible for foulant cleanup and removal, such as solvation and changing vapor-liquid equilibrium within the TLE tubes. However, even these primary processes may sometimes benefit from introduction into the cracked effluent stream and TLE at a velocity that is at least as high as the velocity of the effluent stream, and preferably even higher. Thereby, flushing fluid mechanical energy may supplement the primary mechanisms.

Referring again to FIG. 1, in yet another aspect, this invention also provides a TLE assembly 10 including (a) a TLE 90 comprising a through bore, the TLE for cooling a cracked effluent; and (b) an apparatus 10 for intermittently introducing a flushing fluid F through the TLE 90 through bore for cleaning and maintaining the cleanliness of the TLE. Preferably the flushing fluid is introduced into the TLE at a flushing fluid rate of from about 0.5 pounds-mass to about 5 pounds-mass of flushing fluid per pound-mass of cracked effluent feeding through the TLE through bore, based upon the weight of the cracked effluent stream. The apparatus preferably includes a cracked effluent inlet that is in fluid communication with a plurality of single-pass radiant tubes 62 associated with a cracking furnace that produces the cracked effluent. Also, the TLE may be close-coupled to a serpentine cracking coil furnace 12 (FIG. 2) and preferably the TLE is used to cool process gases resulting from a hydrocarbon cracking process, most preferably from cracking a liquid feedstock in a gas cracker.

As will be described in more detail below, in some preferred embodiments, the apparatus 10 may include a nozzle 70 or flow control orifice (not shown) to control flushing fluid introduction rate and/or to energize or otherwise increase the velocity and mixing energy of the flushing fluent as the flushing fluid F is introduced into the cracked effluent stream. The nozzle 70 or flow control orifice is thus in fluid communication with first inlet 96 of housing 50. Although it is not necessary that the flushing fluid be introduced at any particular velocity, as the preferred cleaning mechanisms include solvation and vapor liquid equilibrium changes, increased velocity may tend to favor improved tar foulant removal due to improved dispersion and mixing with the cracked effluent and engagement of the inner surfaces of the TLE.

In some embodiments, the nozzle may be a critical flow nozzle that introduces the flushing fluid at or above a nozzle critical flow point. As may be appreciated by those skilled in the art, critical flow nozzle 70, also known as a sonic nozzle or critical flow venturi, may act as a constant volumetric flowmeter. The geometry is such that the fluid is accelerated along the circular arc converging section and then is expanded in a conical diverging section, which is designed for pressure recovery. In the throat, or minimum cross-sectional area point of critical flow nozzle 70, the gas velocity becomes equal to the speed of sound. At this point, gas velocity and density are maximized, and the mass flow rate is a function of the inlet pressure, inlet temperature, and the type of fluid. The benefits attendant with the use of critical flow nozzle 70 include the fact that mass flow varies linearly with inlet pressure, eliminating the need for differential pressure measurement, the flow rate is not affected by downstream flow disturbances and that mass flow is constant with varying downstream pressure.

As may be appreciated by those skilled in the art, a flow control orifice (not shown) may be substituted for critical flow nozzle 70. Of course, certain advantages attendant with the use of critical flow nozzle 70 will not be realized with the use of or flow control orifice. Such advantages, as indicated above, include the fact that mass flow varies linearly with inlet pressure, flow rate is not affected by downstream flow disturbances, and that mass flow is constant with varying downstream pressure.

Figure 2:
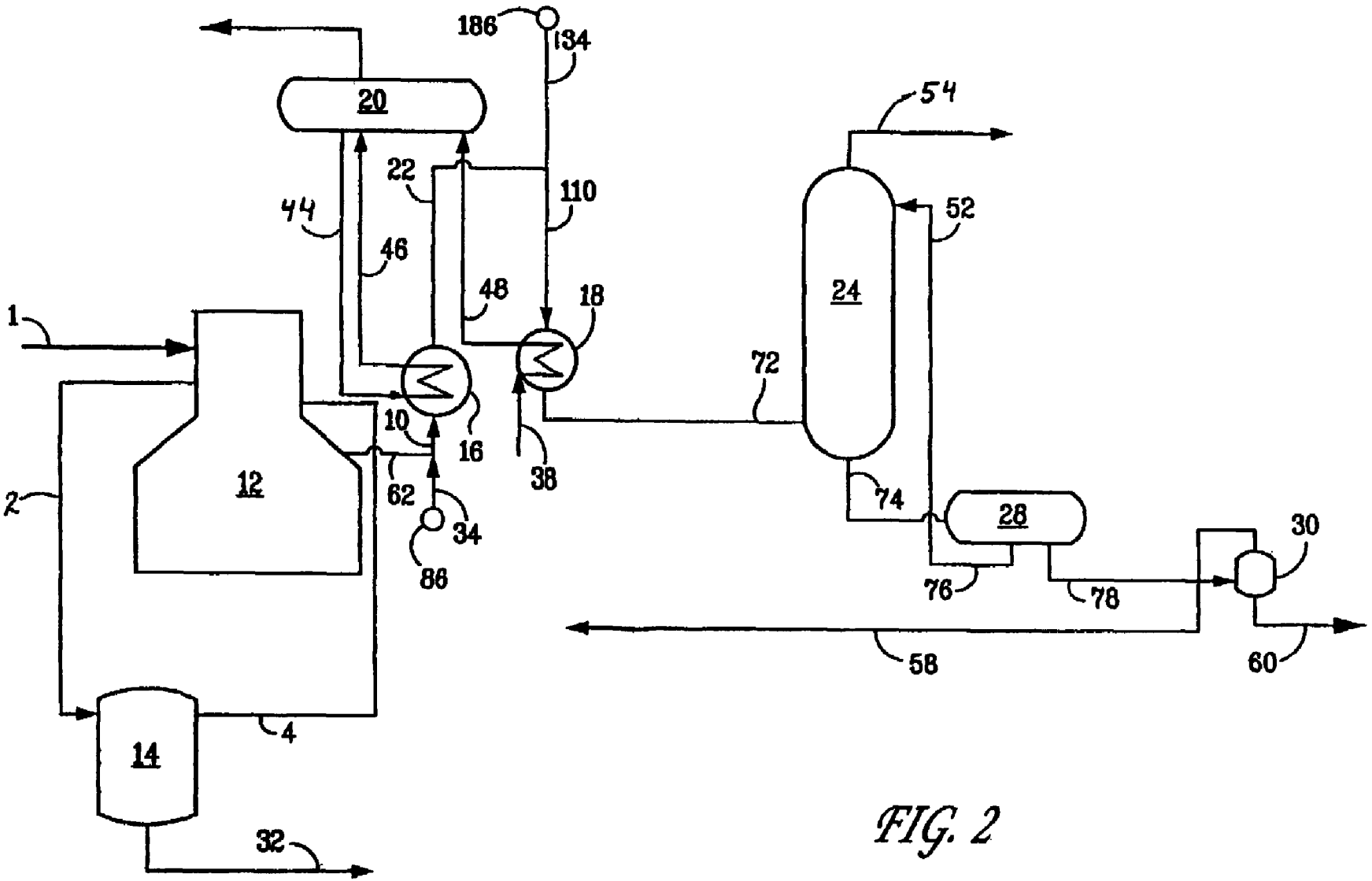
FIG. 2 is an exemplary schematic diagram of a steam cracking system for carrying out a process employing a transfer line exchanger including an apparatus for cleaning and maintaining the cleanliness of a transfer line exchanger tube of the type disclosed herein.

Referring to FIG. 2, device 10 may permit a high-pressure primary TLE 16 to run on feeds 1 that produce high tar levels. Such feeds are typically capable of fouling the TLE tubes rapidly. The TLE tubes are cleaned with flushing fluid intermittently while the cracked effluent stream remains on-line. The flushing fluid may be introduced on the run, with frequent, short duration, intermittent injection of a flushing fluid F that is fed into the TLE through device 10. Some preferred flushing agents include de-asphalted tar and/or full tar (about 550° to about 1000° F. (about 288° C. to about 538° C.)). As may be appreciated, when quench oil and/or de-asphalted tar and/or full tar is injected into the TLE at rates typical of quench headers, so as to avoid fully flashing, the removal of TLE foulant is primarily via salvation. The flushing fluid type may also be alternated, such as for example between steam for one interval and then followed by a hydrocarbon based fluid for the latter portion of the introduction period. Alternatively, for example, on full flushing period may be by steam and the next full flushing period may be by hydrocarbon flushing fluid. Many variations are too numerous to list all, but are included within the scope of the invention.

Another preferred flushing fluid is steam. Steam may act to remove the foulant by changing the vapor liquid equilibrium of the cracked effluent stream, by reducing the hydrocarbon partial pressure. Thereby, the deposited foulant may vaporize before it has time to fully crosslink or become non-volatile, as could otherwise occur over an extended duration of time. Generally, the hotter the steam, the better. Another preferred flushing fluid is a hydrocarbon based flushing fluid, e.g., quench oil. Quench oil may act to remove the tar based foulant by salvation. The point of introduction upstream of the TLE and downstream of the radiant section of the furnace will depend upon several factors, such as temperature of the effluent stream at various points along the flow path, type of flushing fluid, TLE capability, system capacity, and similar factors. If quench oil is used as the flush fluid, consideration must be given in the point of introduction to ensure that the quench oil does not also crack and/or contribute to further foulant deposition or otherwise lose its effectiveness as a solvent. One preferred quench oil that has been found effective for introduction just upstream of the primary TLE 16 is a hydrocarbon fraction having a boiling point of from about 430° F. to about 550° F. (221° C. to about 288° C.) that is also highly aromatic. With steam, the amount of steam introduced and the resulting pressure or increases should also be considered. It has been found that the amount or rate of flushing fluid introduction may vary according to system and feed variables, but generally a flushing fluid introduction rate of from about 0.5 pounds to about 5 pounds of flushing fluid per pound of cracked effluent provides effective results.

Advantageously, de-fouling of the TLE tube 90 is preferably and most effectively achieved while the TLE foulant is relatively fresh and not yet cross-linked. This suggests that increased frequency may facilitate improved TLE cleaning. Balancing this is the concern with maintaining overall system efficiency and not overloading the system with flushing fluid. While the frequency and/or duration of the flush requirements is a function of the tar yield of a particular feed and higher for a secondary TLE than a primary TLE (due to thicker foulant to dew point at lower bulk temperatures), an exemplary estimate for flushing with a typical heavy feed may be twice per day for less than about 30 minutes for a primary TLE. As such, flushing each TLE tube 90 less than one hour per day should maintain the TLE in a near clean condition, increasing the capacity of valuable high pressure steam generation and reducing TLE coking pressure drop buildup, which reduces furnace cracking selectivity.

As such, in another form a process for cleaning and maintaining the cleanliness of a transfer line exchanger tube 90 is provided that includes the steps of intermittently introducing a flushing fluid F upstream of the transfer line exchanger tube 90 and removing a tar-based foulant from the transfer line exchanger tube before the tar-based foulant cross-links, wherein the flushing fluid F may be introduced at least twice per day, preferably for a period of less than about 60 minutes, and may even be a relatively short flushing period, for example as low as a thirty second introduction period. It is envisioned that this method of online cleaning will significantly reduce the necessity of decoking a heavy feed furnace system solely for the purpose of cleaning a fouled TLE. As indicated, use of this method of injecting decoking steam, quench oil, or de-asphalted tar at a high rate into the TLE cooling tube on a daily basis significantly reduces the total time required for removing the foulant from the walls of TLE tube 90. High-pressure steam generation will be increased, as the TLE will be maintained in a near clean condition. The high mass velocity, high linear velocity of the decoking steam, quench oil, or de-asphalted tar may sweep away the viscous liquid tar layer before it has had sufficient time to polymerize or otherwise crosslink. Thus, where it would normally take about one hour of decoking for each day of operation, utilizing the device 10 and processes disclosed herein may require only 25% to 50% of that time, if done in accordance herewith.

Flushing can be automated and sequenced in such a way as to minimize overall plant quench and TLE high pressure steam rate variations. Flushing is done intermittently, at intervals that may be intermittently regular or irregular, such as on an as needed basis. Similarly, the flushing fluid introduction period may also be a set period, a pattern of periods, or on an as needed basis. An objective is to maximize overall system efficiency with the cleaning. In this form, significantly more high-pressure steam will be produced in the primary and/or secondary TLE on heavy feed when compared to cases where no flush is employed. Moreover, significantly more high-pressure steam can be produced with a secondary TLE when compared with a secondary TLE that employs continuous quench oil injection, with only about 20% of the total quench oil requirement. This is due to the fact that the hot process gas requires such high volumes of continuous quench oil injection to keep the TLE clean, that the process duty of the secondary TLE goes primarily into heating up the quench fluid with low high-pressure steam production. In another form, the device 10 disclosed herein also allows the radiant tubes to run on feed while the TLE is being cleaned.

Increasing the mass velocity in the TLE cooling tube 90 by the injection of quench oil, de-asphalted tar, full tar or dilution steam at a high rate to lower the foulant partial pressure, depending on the flushing fluid F, will volatilize, solvate or mechanically remove the lighter components in the amorphous coke deposit on the TLE cooling tube 90 wall to weaken it and sweep away the weakened coke structure and any of the viscous liquid layer which has not yet polymerized. As indicated, this operation can be performed while the furnace is online and producing valuable product. While it is the conventional view that the foulant so formed is a solid coke-like structure that must be removed by either spalling, erosion with spalled radiant coke particles or burning, it has been found that fresh TLE foulant is a viscous liquid and can be easily removed via decoking. For example, a day old foulant is relatively easy to remove, since the substantial cross-linking required to form a solid structure may take on the order of weeks.

When operating on a very heavy feed that has a high initial fouling rate, the decoking steam, quench oil, de-asphalted tar, or full tar may be injected for approximately 10 minutes every 12 hours to maintain the TLE in a nearly clean condition thus increasing the generation capacity of valuable high pressure steam and reducing TLE coking pressure drop buildup which reduces furnace cracking selectivity. This online cleaning would also permit very heavy feeds to be run in a TLE designed to cool the effluent to a lower temperature. For example, heavy feed exchangers could be designed to cool the effluent to 850° F. (454° C.), rather than 950° F. (510° C.), and recover the extra high pressure steam production. The frequency of online cleaning could be adjusted so as to maintain the exchangers in a near clean condition.

Referring again to FIG. 1, as indicated above, device 10 includes flushing fluid nozzle 70 or flow control orifice (not shown) in fluid communication with first inlet 96 of housing 50 and TLE tube 90. A distribution manifold 86 supplies a flushing fluid F, which may be steam, quench oil, de-asphalted tar or full tar, to each bank of devices 10 and TLE tubes 90. The individual flow nozzles 70 or flow control orifices deliver a predetermined flow rate of steam, quench oil, de-asphalted tar or full tar to each TLE tube 90 in that bank. It is envisioned that each manifold 86 will be equipped with its own individual block valve (not shown) and that one automatic on/off valve (not shown) will be used to commission the steam, quench oil, de-asphalted tar or full tar flow to all the decoking manifolds 86.

To maintain the individual flow nozzles 70 or flow control orifice in a clean condition and prevent hydrocarbons from backing through the flow nozzles 70 or flow control orifices when not in service, a small flow of superheated purge steam may be supplied to each of the individual distribution manifolds 86. While steam, quench oil, de-asphalted tar or full tar is being injected, the high pressure steam production from that individual TLE 16 will be significantly reduced. However, since only one TLE 16 is being cleaned at a time, there will be very little impact on the overall steam production from the entire furnace.

When employing steam for the decoking operation, it may be provided at a relatively low pressure, such as at about 125 psig, and can be superheated in a coil located in the convection section or in a coil submerged in a high pressure 1500 psig steam drum. Alternatively, the steam need not be superheated steam.

When employing quench oil, de-asphalted tar or full tar, such a stream may be injected at a rate of about 1.25 lbs. to about 3.5 lbs. of quench oil or de-asphalted tar for every pound of feed processed. More quench will be required for a primary TLE to keep it from flashing and allow it to wash off the foulant, since the primary TLE inlet process temperature is much hotter than that of the secondary TLE.

A thermal sleeve backed by a layer of refractory Nextel® ceramic cloth may be provided to protect the shell of the injection fitting from the thermal shock accompanying the injection of about 650° F. (343° C.) steam into an about 1500° F. (816° C.) or greater cracked gas stream. Nextel® ceramic cloth is available from 3M Company of St. Paul, Minn.

In another form, the device 10 can be used during an offline steam air decoking operation to shorten the time to clean a heavily fouled TLE. TLE decoking can start simultaneously with radiant coil steam air decoking without affecting radiant steam air decoking.

Referring now to FIG. 2, a schematic representation illustrating a steam cracking system employing the device for cleaning and maintaining the cleanliness of a transfer line exchanger tube disclosed herein is presented. As illustrated in FIG. 2, the steam cracking system includes a steam cracking furnace 12, which includes a convection section in the upper part of the steam cracking furnace 12 and a radiant section in the lower part of the steam cracking furnace 12. In the convection section of the thermal cracking furnace, there may be disposed, as is conventional, a tube-type first preheater, an economizer tube, a tube-type second preheater and a tube-type dilution-steam superheater (not shown), from the top to the bottom. In the radiant section of the cracking furnace 12 are disposed, as is typical, a thermal cracking reactor comprising a tubular reactor, and a burner (not shown) for heating the cracking furnace.

Feed line 1 supplies a hydrocarbon feed to cracking furnace 12. Within cracking furnace 12, the hydrocarbon feed is heated to cause thermal decomposition of the molecules. As indicated, the steam cracking process occurring in steam cracking furnace 12 produces some molecules which tend to react to form heavy oils and tars.

A flash stream 2 may be removed from cracking furnace 12 and sent to optional flash/separation vessel 14, where the vaporized overhead stream 4 is sent back to the cracker, and preferably to the convection section. A portion of feedstock 1 may be blended into flash stream 2 before entering flash/separation vessel 14. Flash stream 2 and optional feedstock 1 is then flashed in a flash/separation vessel 14, for separation into two phases: a vapor phase comprising predominantly volatile hydrocarbons flashed from the hydrocarbon feedstock 1 and a liquid phase comprising less-volatile hydrocarbons along with a significant fraction of the non-volatile components and/or coke precursors. It is understood that vapor-liquid equilibrium at the operating conditions described herein would result in small quantities of non-volatile components and/or coke precursors present in the vapor phase. Additionally, and varying with the design of the flash/separation vessel, quantities of liquid containing non-volatile components and/or coke precursors could be entrained in the vapor phase.

For ease of description herein, the term flash/separation vessel will be used to mean any vessel or vessels used to separate the flash stream 2 and optional feedstock 1 into a vapor phase and at least one liquid phase. It is intended to include fractionation and any other method of separation, for example, but not limited to, drums, distillation towers, and centrifugal separators. Flash separators having utility herein and their operational details are disclosed in U.S. Publication No. 2005/0261537, filed on May 21, 2004, the contents of which are hereby incorporated by reference in their entirety.

The flash stream 2 and optional feedstock 1 mixture stream is introduced to the flash/separation vessel 14 through at least one inlet of the vessel and the vapor phase is preferably removed from the flash/separation vessel 14 as an overhead vapor stream 4. The vapor phase is fed back to the convection section of cracking furnace 12, which may be located nearest the radiant section of cracking furnace 12, for heating and then to the radiant section of the cracking furnace 12 for cracking. The liquid phase of the flashed mixture stream is removed from the flash/separation vessel 14 as a bottoms stream 32.

The gaseous product effluent from the steam cracking furnace 12 is transferred through line 62 for cooling within at least one transfer line exchanger, in this case primary TLE 16. Water is supplied by steam drum 20 through line 44 and steam/water returned to steam drum 20 through line 46 for heat exchange with the product effluent within primary TLE 16. As indicated above, in conventional gas steam cracking systems, when the feedstock window is broadened to include feeds that make >2 wt % tar, the primary TLE 16, which generates high pressure steam, will foul with condensed heavy components from the tar, increasing outlet temperature substantially, while reducing high steam generation. Product effluent exits primary TLE 16 through line 22 for further processing.

To address the fouling issue, device 10 is installed upstream of primary TLE 16 to provide the capability of periodic flushing to the hydrocarbon effluent feeding primary TLE 16. Referring also to FIG. 1, steam, quench oil, deasphalted tar or full tar from distribution manifold 86 is fed by line 34 to device 10 to remove condensed tar foulant before it crosslinks and hardens on TLE tube 90 of primary TLE 16. Flushing can typically be performed twice daily for periods of about 15 minutes to about 30 minutes per TLE tube. Advantageously, flushing is done on each TLE tube octant or quadrant to minimize the impact on downstream operations. This enables the primary TLE 16 to run continuously while maximizing steam generation with feeds that may include up to 40 wt % tar, such as kerosene or crude. As may be appreciated by those skilled in the art, it may be necessary to upgrade the metal components downstream of primary TLE 16 to the quench section to allow higher primary TLE outlet temperatures.

Figure 3:
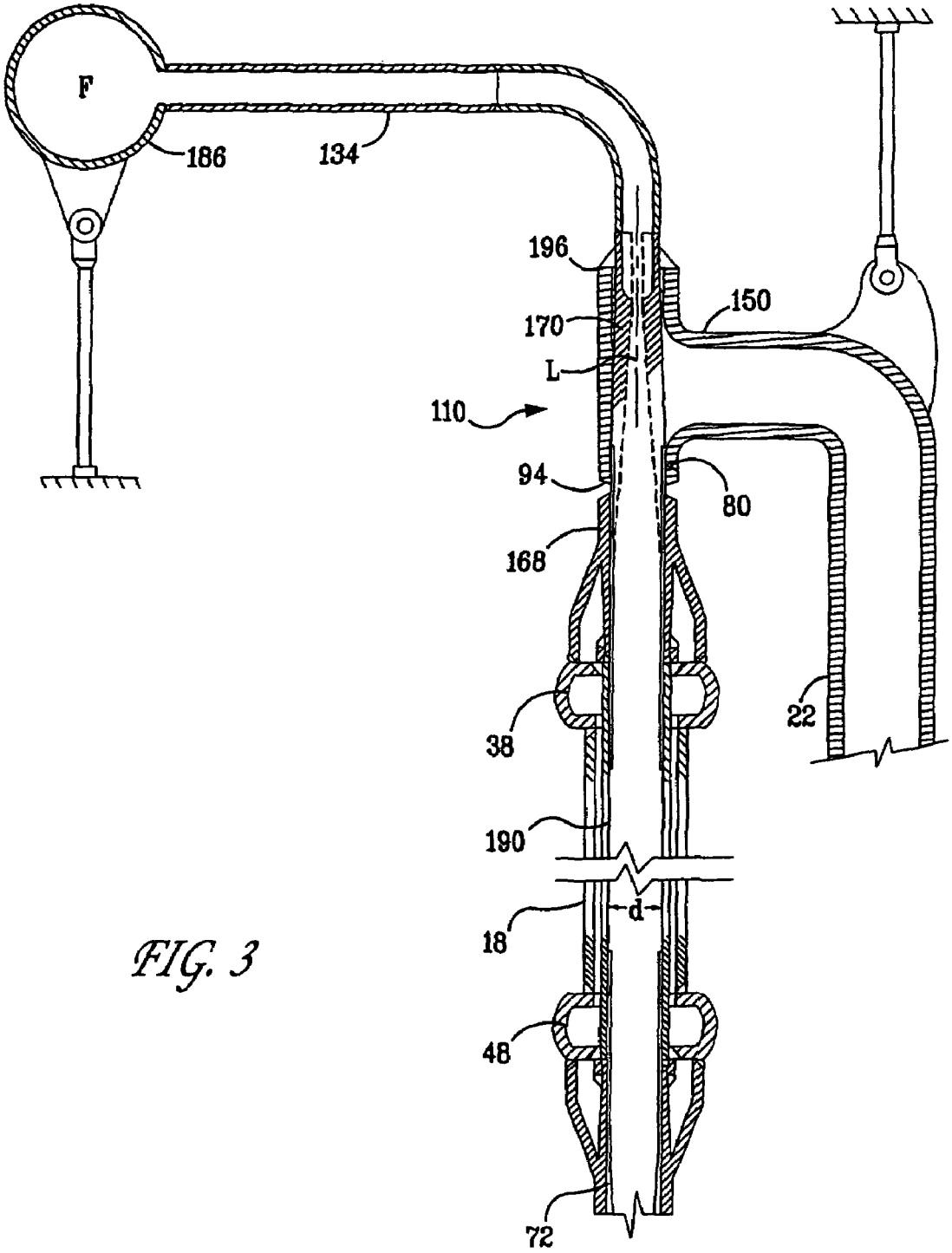
FIG. 3 is an exemplary cross-sectional illustration of a TLE, such as a secondary TLE, including an apparatus for cleaning and maintaining the cleanliness of a TLE according to the present invention.

Referring now to FIG. 2 and FIG. 3, to achieve additional heat exchange prior to the effluent reaching the quench section, a secondary TLE 18 may be employed downstream of the primary TLE 16. Water is supplied by steam drum 20 through line 38 and steam/water returned to steam drum 20 through line 48 following heat exchange with the product effluent within secondary TLE 18. To maintain the operability of the secondary TLE 18 and keep it relatively free from fouling from condensed tar, a device 110 is installed upstream of secondary TLE 18 to provide the capability of periodic flushing. Once again, steam, quench oil, deasphalted tar or full tar from distribution manifold 186 is fed by line 134 to device 110 to remove condensed tar foulant before it crosslinks and hardens. Flushing can typically be performed twice daily for periods of about 15 minutes to about 30 minutes per TLE tube. It is important that when a hydrocarbon flushing fluid is employed that the fluid is heavy enough not to flash at secondary TLE conditions. Suitable hydrocarbon-based fluids include the 430° F. to 550° F. (221° C. to 288° C.) fraction of the steam cracking product effluent. As may be appreciated by those skilled in the art, the yield for such a solvent is high enough during crude and kerosene cracking, but would be expected to be insufficient, requiring importation, for the case where the liquid feed is naphtha, field natural gasoline or condensates.

Referring to FIG. 3, device 110 for cleaning and maintaining a secondary TLE tube 190 in an almost clean state in heavy feed cracking and high TLE fouling service is shown. The device 110 includes a housing 150 having a first end 192, a second end 194 and a longitudinal axis L. Housing 150 further includes a first inlet 196 for introducing a flushing fluid F to the transfer line exchanger tube 190, the first inlet 196 disposed proximate to the first end 192 of the housing 150. Housing 150 also includes a second inlet 198 for providing a product effluent comprising hydrocarbons and an outlet 80 for placing in fluid communication with an inlet 168 of the secondary transfer line exchanger tube 190. As previously described for the form of FIG. 1, a critical flow nozzle 170 or flow control orifice (not shown) is provided, critical flow nozzle 170 or flow control orifice in fluid communication with first inlet 196 of housing 150.

Distribution manifold 186 supplies a flushing fluid F, which may be steam, quench oil, de-asphalted tar or full tar, to each bank of devices 110 and TLE tubes 190. The individual critical flow nozzles 170 or flow control orifices deliver a predetermined flow rate of steam, quench oil, de-asphalted tar or full tar to each TLE tube 190 in that bank. It is envisioned that each manifold 186 will be equipped with its own individual block valve (not shown) and that one automatic on/off valve (not shown) will be used to commission the steam, quench oil, de-asphalted tar or full tar flow to all the decoking steam manifolds 186.

To maintain the individual critical flow nozzles 170 or flow control orifices in a clean condition and prevent hydrocarbons from backing through the critical flow nozzles 170 or flow control orifices when not in service, a small flow of superheated purge steam may be supplied to each of the individual distribution manifolds 186. While steam, quench oil, de-asphalted tar or full tar is being injected, the high pressure steam production from that individual TLE 18 will be significantly reduced. However, since only one TLE 18 is being cleaned at a time, there will be very little impact on the overall steam production from the entire furnace.

The process disclosed herein remains essentially the same when used with secondary TLE 18. As may be appreciated, compared to using a quench assisted secondary TLE injecting quench oil and/or deasphalted tar and/or full tar continuously, during the time that no quench assistance is employed, the secondary TLE 18 can make substantially more high-pressure steam, despite the fact that it is incrementally fouling. The intermittent flushing disclosed herein will clean up the TLE tube 190 in less than one hour per day. So, while maintaining operability, substantially more steam can be made with short frequent online flushing vs. continuous quench oil and/or deasphalted tar and/or full tar injection. Another significant advantage is that only about 20% of the amount of quench oil is required when compared with continuous injection.

As shown in FIG. 2, the gaseous effluent exits secondary TLE 18 through line 72 and proceeds to the water quench tower 24. At this stage of the process, the gaseous effluent is relatively free of the heavy oils and tars that are capable of forming a stable emulsion with water so that a simple water quench may be used to complete the cooling/condensing process. Upon entering the quench tower 24 the effluent is further cooled with recirculating quench water supplied through line 52. The quench zone of quench tower 28 is of the standard design as is well known in the art. Gaseous products, including olefins and aromatics, may be withdrawn through line 54 and sent to separation into individual product streams.

The quench water is removed from the quench tower 24 through line 74 and flows to an oil/water separation quench drum 28. From quench drum 28, the following liquid streams are withdrawn: light oil, heavy oils, and tar through line 78, and recirculating quench water through line 76. The illustrated solvation system is exemplary only. The solvation system may actually be more complex, including multiple separators, solvation introduction points, and other treating options.

The hydrocarbons withdrawn through line 78 from quench drum 28 may be fed to a light aromatic solvent separator 30. Tar or other recovered heavier fractions may be removed through line 60. The light hydrocarbons separated by the light aromatic solvent separator 30 may be withdrawn through line 58 and sent through line 40 to a tailing tower (not shown), where the bottoms are sent to fuel and the overhead recovers the solvent for reuse. If disposal to a tailing tower is not an option, then these streams can be sent to fuel. Alternatively, recovered solvent may be introduced into quench drum 28 to aid tar/water separation.

The use of at least one device 10 or 110 upstream of at least one TLE 16 or 18, together with the use of periodic fluid flushing, as disclosed herein, serves to enable gas cracker 12 operation with feeds employing higher levels of tar. In plant operation, this permits the relaxation of the maximum tar yield specification for feedstocks from levels that enable only ethane through butane feed. As may be appreciated, in periods of high natural gas pricing, relative to crude, gas cracker plants have economic incentives to move toward the heaviest feeds that are operable with minimum capital investment, despite the fact that the most attractive feeds typically make significantly more tar. As disclosed herein, this is achieved without expensive modifications being made and without frequent shut downs for removal of TLE foulant. Additionally, there is no need to employ a costly primary fractionator in the existing gas cracker system.

Referring again to FIG. 1, in design, the selection of the process tube inside diameter involves a classical design trade-off between various, and sometimes competing, parameters. For single and dual radiant tube coils, maintaining the same flow area as the outlet section 62 of the radiant tube requires TLE tube 90 inner diameters "d" ranging for example, between about 1.85" and 2.45". Mass velocity should be held in the range of about 8 to about 18 lb/sec $f^2$, where mass velocity is calculated using both feed and dilution steam flow. To achieve low exchanger pressure drops, the lower end of this range is often targeted. In order to minimize the time available to form heavy, high boiling point asphaltene-type coke precursor molecules, a time-to-quench target of about 0.025 seconds to drop to about 1250° F. (677° C.) may be sought.

It is desirable in a close-coupled TLE design to achieve a TLE tube pressure drop of about 1.0 to about 2.0 psi for liquid feeds; however, pressure drops on the order of about 8 to about 15 psig pressure drop may occur as a result of the coking exhibited when processing heavy feeds. This becomes a major consideration on gas-oil feeds and favors the design of larger diameter units. The final selection of tube diameter, therefore, is based on a consideration of all of the above factors.

For dual radiant tube units, TLE tubes having inner diameters in the range of about 2.15 to about 2.60" may be employed. The TLE cooling tube inner diameter may be of larger or equal diameter to the radiant tube inner diameter to reduce the risk of trapping coke spalled from the radiant tube. An advantage of the about 2" to about 2.6" inner diameter process tube design is that an acceptable steam-generating TLE outlet temperature can be achieved in a single pass TLE. Larger diameter designs are often forced into a two-leg design or must accept higher than optimum outlet temperatures.

The selection of a target clean TLE outlet temperature is based on considerations of exchanger length, heat recovery and exchanger fouling, when processing liquid feeds. Cooling to lower clean outlet temperature results in accelerated TLE fouling rates for liquid feeds such as heavy naphthas, condensates and gas-oils. For these feeds, the selection of a target clean outlet temperature is made based on achieving an acceptable TLE run length, predicted through the use of an acceptable TLE fouling model.

When processing an ethane feed, the target clean TLE outlet temperature would be expected to be in the range of about 660° F. (348° C.) to about 710° F. (377° C.). When processing a light virgin naphtha (LVN) feed, the target clean TLE outlet temperature would be expected to be about 700° F. (371° C.). Target clean TLE outlet temperatures when processing gas oils would be expected to be in the range of about 950° F. (510° C.) to about 1000° F. (538° C.), with a fouled outlet temperature in the range of about 1200° F. (649° C.) to about 1300° F. (704° C.).

Where rapid TLE outlet temperature rise is experienced due to processing high tar producing feeds such as heavy condensates with very heavy tails, gas oils, crude, and atmospheric resid with high tar yields, the TLE pressure rise and outlet temperature rise may necessitate lengthening the period for flushing. This may become necessary since, as the TLE tubes coke, high pressure steam generation is significantly reduced, to often less than 50% of clean rates, making the economics of using a TLE for quenching unattractive. The increased pressure drop of the fouled TLE tubes also reduces cracking selectivity.

Furnaces designed for heavy feed cracking with clean TLE outlet temperatures of about 950° F. (510° C.) and fouled outlet temperatures of about 1300° F. (704° C.) may require secondary oil quench points downstream of the primary steam generating TLE. In such cases, it would be desirable to have a separate gas-oil secondary quench point for each TLE to minimize the length of high temperature piping from the TLE outlet to the quench point inlet.

If a higher pressure steam generating secondary TLE is used to produce steam downstream of a primary TLE, a significant amount of high pressure steam can be produced if the inlet temperature is kept above about 900° F. (482° C.) on a non-fouling feed without quench assistance. If the feed cracked produces high tar yields (>5 wt %), both the primary TLE and secondary TLE fouling will be significant and rapid. As the tar yield and severity increase the rate of fouling goes up dramatically. To address this issue, the secondary TLE may be quench-assisted. In this form, the short primary TLE fouls on high tar feeds, but can be partially de-fouled during decoking. The fouled outlet temperature of the primary TLE may be as high as about 1200° F. (649° C.). The quench-assisted secondary TLE follows the primary TLE and injects quench oil at the inlet of the secondary TLE. The down-flow quench assisted TLE reduces the impact of secondary TLE fouling by solvating the heavy tar foulant before it condenses and polymerizes on the cold TLE walls.

If the tar yield is very high, the furnace run-length will likely be constrained by the ability to decoke the primary TLE. A high primary TLE outlet temperature may also result in some fouling toward the inlet of the quench assisted TLE, if the first stage TLE outlet temperature break point is so high that all the quench oil flashes. This problem can be mitigated by injecting quench oil at a higher rate; however, if some quench oil must remain liquid after the equilibrium flash, the reduction in the secondary TLE inlet temperature will result in a lower driving force for high pressure steam generation. This problem could be avoided through the use of existing quench header technology, but that would result in major investment in conventional primary fractionator technology for heat recovery and result in reduced process energy efficiency. If the quench oil for the quench-assisted secondary TLE were replaced with a completely non-volatile quench fluid, the TLE could remain cleaner, but the liquid film would have a very poor heat transfer coefficient. The best choice of quench oil is one that is heavy enough not to completely flash at relatively high TLE inlet temperatures (>850° F. (>454° C.)) and contains a broad boiling range, possessing some lighter molecules, so that the quench injection behaves as a boiling liquid. This will greatly assist in heat transfer and provide the desired levels of TLE steam generation, with a reasonable overall TLE heat transfer surface area.

As may therefore be appreciated, if too little quench oil is continuously injected into the secondary TLE, it will foul; if enough is added to maintain a clean liquid wash, steam generation will be low. The use of a heavy quench oil, a portion of which is de-asphalted tar having a boiling range of about 500° F. (260° C.) to 1000° F. (538° C.) will directionally help; but the use of a continuous injection of a mix of quench oil and de-asphalted tar will yield operability issues at low injection rates or low steam production, since so much quench oil must be used to mitigate secondary TLE fouling when the inlet process temperature is between about 900° F. (482° C.) to about 1200° F. (649° C.) (quench oil typically boils between about 430° F. (221° C.) and about 550° F. (288° C.)). More steam production is made possible by periodic flushing with the device disclosed herein, rather than by using a continuous wash system.

The inventive aspects discussed above and herein include systems, processes, and apparatus for practicing the invention to reduce TLE fouling and tar buildup, and to facilitate use of a variety of liquid feedstocks through thermal pyrolysis cracker systems. For example, this invention may facilitate feeding liquid feedstocks through gas cracker systems, or use of heavier, higher tar-yielding feeds through steam or other liquid thermal cracker systems. Among these inventive aspects a preferred system is provided for on-line cleaning of a foulant from a TLE assembly. The system preferably comprises (a) a TLE comprising a through bore, the TLE for cooling a cracked effluent; and (b) an apparatus for intermittently introducing a flushing fluid through the TLE through bore for cleaning and maintaining the cleanliness of the TLE; wherein the flushing fluid is introduced preferably intermittently, at a flushing fluid rate of from about 0.5 pounds-mass to about 5 pounds-mass of flushing fluid per pound-mass of cracked effluent feeding through the TLE through bore, while the cracked effluent is simultaneously fed through the TLE. The flushing fluid is preferably introduced through the TLE while the cracked effluent is fed through the TLE at a cracked effluent mass flow rate of at least twenty-five weight percent (25 wt %) of the average daily rate that the cracked effluent is fed through the TLE when the flushing fluid is not being introduced through the TLE, based upon the total weight of the cracked effluent stream fed through the TLE. More preferably, the flushing fluid is introduced through the TLE while the cracked effluent is fed through the TLE at a cracked effluent rate of at least fifty weight percent (50 wt %), still more preferably at least ninety weight percent (90 wt %), and still more preferably at about the full (100 wt %), of the average daily rate that the cracked effluent is fed through the TLE when the flushing fluid is not introduced through the TLE, based upon the total weight of the cracked effluent stream fed through the TLE. The flushing fluid is intermittently introduced into the TLE at least once per week and preferably at least once per day. The intermittent intervals may be periodically regular or irregular, or as needed or desired. The flushing fluid is preferably introduced to remove tar-based foulant from the TLE before the tar-based foulant crosslinks, including before the foulant polymerizes, hardens, or otherwise becomes relatively immovable except by mechanical intervention or off-line cleaning. The flushing fluid removes the tar-based foulant from the TLE primarily by at least one of (i) solvation of the foulant, and (ii) volatizing the foulant by reducing the hydrocarbon partial pressure in the cracked effluent stream. The term TLE includes a primary TLE, secondary TLE, or other TLE, TLE-type apparatus, or effluent quenching or conducting component, such as and including effluent transfer and control piping.

Also provided is a process for cleaning a TLE system. In a system for cracking hydrocarbons including a hydrocarbon pyrolysis furnace that produces a stream of cracked effluent and a transfer line heat exchanger tube (TLE) that quenches the cracked effluent stream, a process for cleaning and maintaining the cleanliness of the TLE, the inventive process comprises introducing a flushing fluid into the stream of cracked effluent in the TLE while the cracked effluent is fed through the TLE to remove foulant from the TLE. The flushing fluid is preferably introduced at a flushing fluid rate of from about 0.5 pounds-mass to about 5 pounds-mass of flushing fluid per pound-mass of cracked effluent. The flushing fluid is introduced intermittently. In one aspect, the flushing fluid is introduced at least about once every week. In another more preferred aspect, the flushing fluid is introduced at least about once every day. It may be preferred that the flushing fluid is introduced for a duration period of from about thirty seconds to about sixty minutes. Preferred flushing fluid includes at least one of steam, water, hydrocarbon quench oil, deasphalted tar, and/or full tar.

The TLE comprises an upstream or inlet end for receiving the cracked effluent and flushing fluid into the TLE and a downstream or outlet end for discharging the cracked effluent and flushing fluid from the TLE. Thereby, the flushing fluid flows through the TLE through bore. In a preferred embodiment, the TLE comprises a flow path axis at an upstream end of the TLE, although the TLE need not necessarily be a fully linear TLE. The flushing fluid is introduced into the TLE substantially along the flow path axis at the upstream end of the TLE. Thereby, the flushing fluid is essentially directed along the through bore flow path through the TLE. In other embodiments, the TLE comprises a flow path axis at an upstream end of the TLE and the flushing fluid is introduced into the TLE at an acute angle with respect to the flow path axis at the upstream end of the TLE, where the flushing fluid is mixed with the cracked effluent and the cracked effluent stream is essentially directed along the through bore flow path at the inlet to the TLE. In either aspect, it may be preferred that the flushing fluid is introduced into the cracked effluent through a fluid accelerator, e.g., such as a nozzle or orifice, that preferably accelerates the velocity of the flushing fluid along a flushing fluid axis as compared to a velocity of the flushing fluid velocity upstream of the fluid accelerator or nozzle device.

In another aspect, the inventions set forth herein also include a process for introducing a flushing fluid into a stream of cracked effluent moving through a TLE to clean the TLE, wherein the process introduces flushing fluid into the effluent stream from a flushing fluid apparatus that comprises a housing having a first end, a second end, the housing further including a first inlet for introducing a flushing fluid into the flushing fluid apparatus, the first inlet disposed proximate the first end of the housing, a second inlet for providing the effluent stream into the flushing fluid apparatus, and an outlet in fluid communication with an inlet of the TLE and in fluid communication with both the first inlet and the second inlet. In one preferred embodiment, the first inlet and the outlet are coaxially disposed on a longitudinal axis that extends through the apparatus between the first inlet and the outlet. Alternatively, the second inlet is positioned at an angle to the longitudinal axis, preferably at an acute angle to direct the flushing fluid and cracked effluent generally along a common flow path. Preferably the flushing fluid is introduced to the effluent introduction devices or apparatus by a distribution manifold that serves a number of introduction apparatuses.

The TLE is used to cool, e.g. quench, effluent from a cracking furnace and preferably to cool process effluent resulting from a gas cracking process. Preferably, the TLE is used to cool cracked process effluent resulting from cracking of a condensate, light virgin naphtha, heavy virgin naphtha, field natural gasoline, or kerosene.

In another aspect of the invention, an inventive process is provided that is a component of a system for thermal cracking gaseous feedstocks. The system includes a pyrolysis unit/thermal cracker for cracking the gaseous feed and produces a cracked effluent stream comprising olefins, and at least one TLE for the recovery of process energy from the effluent. The inventive process facilitates extending the range of cracker system feedstocks for cracking to include liquid feedstocks that yield up to 40 wt % tar. The process comprises the steps of intermittently: (a) introducing a flushing fluid into the cracked effluent stream from an introduction point that is upstream of the at least one TLE; and (b) simultaneously introducing the cracked effluent stream and the flushing fluid into the at least one TLE to remove a tar-based foulant from the at least one TLE before the tar-based foulant cross-links. The flushing fluid is preferably introduced into the cracked effluent at a frequency of at least about once every week. The flushing fluid is preferably introduced into the cracked effluent by an apparatus that comprises a first inlet for introducing a flushing fluid to the cracked effluent stream, a second inlet for receiving the cracked effluent stream from the thermal cracker and in fluid communication with the first inlet, and an outlet in fluid communication with both the first inlet and the second inlet and an inlet to a TLE, the outlet to introduce the cracked effluent and the flushing fluid simultaneously into the TLE. Preferably the process also includes using a nozzle or orifice for distributing the flushing fluid into the TLE, wherein the nozzle or flow control orifice is in fluid communication with the first inlet of the housing. The cracked effluent and the flushing fluid are preferably also at least partially mixed within the apparatus to form a mixed stream before the mixed stream is introduced into the at least one TLE. Preferably the flushing fluid is introduced at a flushing fluid rate of from about 0.5 pounds-mass to about 5 pounds-mass of flushing fluid per pound-mass of cracked effluent. Also, it may be preferably in some applications that the flushing fluid is introduced at a frequence of about once every six hours for a period of less than about 60 minutes. As mentioned previously, in many applications, the cracked effluent stream results from thermally cracking a hydrocarbon feed, wherein the hydrocarbon feed includes one or more of steam cracked gas oils and residues, heating oil, jet fuel, diesel, gasoline, coker naphtha, hydrocrackate, reformate, raffinate reformate, distillate, crude oil, atmospheric pipestill bottoms, vacuum pipestill streams including bottoms, wide boiling range naphtha to gas oil, naphtha contaminated with crude, atmospheric residuum, C4/residue admixtures, and naphtha residue admixtures, a condensate, heavy virgin naphtha, field natural gasoline or kerosene fed process.

EXAMPLES

Example 1

In the form depicted by FIG. 1, a critical flow nozzle 70 with a 0.56 inch diameter throat is used at the entrance of each TLE cooling tube 90. For this example, 1213 lbs/hr of 125 psig steam, superheated to 650° F. (343° C.) is injected into each TLE cooling tube 90. The hydrocarbon and dilution steam rate to each cooling tube 90 of the TLE prior to decoke steam injection is 1714 lbs/hr and the hydrocarbon partial pressure at the outlet of the cooling tube 90, where the maximum thickness of coke is present, is 13.2 psia. With steam injection, the hydrocarbon partial pressure drops and the outlet velocity increases from 453 ft/sec to 700 ft/sec. The mass velocity on a clean TLE tube basis increases from 18.36 lb/sec/ft$^2$ to 31.36 lb/sec/ft$^2$.

In this example, the pressure drop in the clean TLE tube 90 is 3 psig, but has increased to 5 psig prior to the online TLE decoking operation. The pressure drop at the start of the online decoking operation will increase to 13 psig but quickly drop to 8 psig, as the coked cooling tube 90 is cleaned. The pressure drop after the decoking steam is removed will return to the clean tube pressure drop of 3 psig. The additional eight psig of pressure drop at the start of the decoking operation would be expected to be within the allowable pressure shock of the radiant inlet critical flow distribution nozzles 70, thereby not affecting the flow through the radiant tubes 62. In this example the radiant coil outlet temperature (COT) is 1526° F. (830° C.). The decoking steam addition drops this temperature to 1192° F. (644° C.) prior to entering the TLE cooling tube 90.

One useful decoking method involves the injection of 125 psig steam superheated to 650° F. (343° C.). This superheated decoking steam will reduce the remote possibility of dropping out heavy, high boiling point asphaltene-type molecules at the injection point. The higher the superheated steam temperature, the less likely the possibility of dropping out heavy high boiling point asphaltene-type molecules at the injection point.

Although somewhat less effective, saturated 125 psig steam could be used. Its mixed temperature, according to this example, would be 1075° F. (580° C.), with a 0.52 diameter throat critical flow nozzle 70 being used.

Example 2

A standard 40 ft long TLE processing 27,750 lbs. heavy feed having a clean outlet temperature of 837° F. (447° C.)

and clean outlet pressure drop of 0.94 psig will reach end of run conditions in 639 hours. The outlet temperature will increase to 1120° F. (604° C.) and the pressure drop will increase to 9.7 psig. The run average outlet temperature will be 1070° F. (577° C.) and run average pressure drop will be 6 psig. The run average steam produced is 15,422 lbs./hr. The run average quench oil required to quench the TLE effluent to 570° F. (300° C.) is 60534 lbs./hr.

Using the flushing device disclosed herein and flushing for 15 minutes every 6 hours using 3.5 lbs of quench oil per pound of feed, the run outlet temperature is maintained at 913° F. (490° C.) and the run average steam production increases to 19210 lbs./hr. The run average pressure drop decreases to 2.2 psig and the run average quench oil including the flushing oil required to quench the TLE effluent to 570° F. (300° C.) is only 45,660 lbs./hr., because of the lower pressure drop. The run average ethylene increases by 0.5%.

All patents, test procedures, and other documents cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the invention, including all features which would be treated as equivalents thereof by those skilled in the art to which the invention pertains.

What is claimed is:

1. An apparatus for cleaning and maintaining the cleanliness of a TLE, the apparatus comprising:

(a) a conduit including a first inlet for introducing a flushing fluid into a stream of cracked effluent flowing through the conduit, a second inlet for providing the cracked effluent flow into the conduit, and an outlet in fluid communication with both the first inlet and the second inlet, and a critical flow nozzle positioned within the first inlet of the conduit and coaxially disposed along a common longitudinal axis with said outlet, to introduce the flushing fluid and the cracked effluent into a TLE inlet, and wherein said second inlet is positioned at an acute angle to said common longitudinal axis;

(b) a flushing fluid source for providing the flushing fluid to the first inlet in the conduit; and (c) a cracked effluent source for providing the cracked effluent to the second inlet of the conduit.

2. The apparatus of claim 1, wherein the flushing fluid is selected from the group consisting of steam, quench oil, deasphalted tar and full tar.

3. The apparatus of claim 1, wherein the flushing fluid is introduced into the first inlet from a distribution manifold.

4. The apparatus of claim 3, wherein the distribution manifold is in fluid communication with a plurality of conduits, and configured to provide flushing fluid to each of the plurality of conduits.

5. The apparatus of claim 1, wherein the TLE is used to cool cracked effluent from a thermal cracking furnace.

6. The apparatus of claim 1, wherein the flushing fluid is introduced at a frequency of at least about once every week.

7. The apparatus of claim 1, wherein the cracked effluent results from cracking one or more of steam cracked gas oils and residues, heating oil, jet fuel, diesel, gasoline, coker naphtha, hydrocrackate, reformate, reffinate reformate, distillate, crude oil, atmospheric pipestill bottoms, vacuum pipestill streams including bottoms, wide boiling range naphtha to gas oil, naphtha contaminated with crude, atmospheric residuum, C4/residue admixtures, and naphtha residue admixtures, a condensate, heavy virgin naphtha, field natural gasoline or kerosene fed process.

8. The apparatus of claim 1, wherein the second inlet is in fluid communication with at least one radiant tube of a cracking furnace.

9. The apparatus of claim 1, wherein the TLE is close-coupled to a serpentine cracking coil furnace.

10. The apparatus of claim 1, wherein the TLE is coupled to a second TLE and the second TLE is configured to receive the cooled cracked effluent from the TLE.

11. The apparatus of claim 1, wherein the second TLE comprises:

(a) a second TLE conduit including a primary inlet for introducing a flushing fluid into the stream of cracked effluent flowing through the second TLE conduit, a secondary inlet for providing the cracked effluent flow from the TLE into the second TLE conduit, and a second TLE outlet in fluid communication with both the primary inlet and the secondary inlet, and a critical flow nozzle positioned within the primary inlet of the second TLE conduit and coaxially disposed along a common longitudinal axis with the second TLE outlet, to introduce the flushing fluid and the cracked effluent into a second TLE inlet; and (b) a flushing fluid source for providing the flushing fluid to the primary inlet.

12. A TLE assembly comprising:

(a) a TLE comprising an inlet and a through bore, the TLE for cooling a cracked effluent; and (b) an apparatus disposed proximate the inlet of the TLE comprising first and second inlets communicating with an outlet, said first inlet comprising a critical flow nozzle coaxially disposed along a common longitudinal axis with said outlet for intermittently introducing a flushing fluid into said apparatus and exiting said outlet through the TLE through bore for cleaning and maintaining the cleanliness of the TLE and wherein said second inlet is positioned at an acute angle to said common longitudinal axis;

wherein the flushing fluid is introduced at a flushing fluid rate of from about 0.5 pounds-mass to about 5 pounds-mass of flushing fluid per pound-mass of cracked effluent feeding through the TLE through bore.

13. The TLE assembly of claim 12, further comprising a cooling tube, wherein said transfer line exchanger through bore is concentrically disposed within the cooling tube.

14. The TLE assembly of claim 12, wherein said second inlet is a cracked effluent inlet in fluid communication with a plurality of single-pass radiant tubes associated with a cracking furnace that produces the cracked effluent.

15. The TLE assembly of claim 12, wherein the TLE is close-coupled to a serpentine cracking coil furnace.

16. The transfer line exchanger assembly of claim 15, wherein said transfer line exchanger is used to cool process gases resulting from a hydrocarbon cracking process.

* * * * *